US011473332B2

(12) United States Patent
Baranski

(10) Patent No.: US 11,473,332 B2
(45) Date of Patent: Oct. 18, 2022

(54) TENT POLE ASSEMBLY

(71) Applicant: Tarek Baranski, Phoenix, AZ (US)

(72) Inventor: Tarek Baranski, Phoenix, AZ (US)

( * ) Notice: Subject to any disclaimer, the term of this patent is extended or adjusted under 35 U.S.C. 154(b) by 49 days.

(21) Appl. No.: 17/116,288

(22) Filed: Dec. 9, 2020

(65) Prior Publication Data

US 2022/0178164 A1 Jun. 9, 2022

(51) Int. Cl.
*E04H 15/60* (2006.01)
*E04H 15/44* (2006.01)
*E04H 15/32* (2006.01)

(52) U.S. Cl.
CPC ..... *E04H 15/60* (2013.01); *E04H 15/44* (2013.01); *E04H 2015/326* (2013.01)

(58) Field of Classification Search
CPC ..... E04H 15/60; E04H 2015/326; A45B 2009/005
See application file for complete search history.

(56) References Cited

U.S. PATENT DOCUMENTS 2,705,015 A * 3/1955 Langlais ..... F16M 11/38 138/148
3,349,526 A * 10/1967 Schuster ..... E04C 3/005 52/223.13
6,286,531 B1 * 9/2001 Joo-Tai ..... E04H 15/60 135/114
6,378,168 B1 * 4/2002 Brady ..... B25G 1/04 16/110.1
10,660,414 B2 5/2020 Lenhart
2021/0388939 A1 * 12/2021 Yang ..... A47C 4/42

FOREIGN PATENT DOCUMENTS

KR 20030006480 A * 1/2003 ..... E04H 15/60
KR 101199333 B1 * 11/2012
KR 20150007112 A 1/2015
KR 101581366 B1 12/2015

* cited by examiner

*Primary Examiner* — Noah Chandler Hawk
(74) *Attorney, Agent, or Firm* — Brad Bertoglio; Intelink Law Group, P.C.

(57) ABSTRACT

A tent pole assembly includes multiple pole segments with a tension line running through them. Line centering components, such as spherical components threaded on the tension line, are provided between adjacent pole sections. Pole sections also include pole connectors, into which or over which adjacent pole sections may be removably positioned. When tension is applied to the tension line, the line centering components facilitate smooth insertion of adjacent pole sections into or over the pole connectors. Springs within the pole connectors or within the pole sections may facilitate ejection of adjacent pole sections upon release of tension from the tension line.

22 Claims, 4 Drawing Sheets

TENT POLE ASSEMBLY

TECHNICAL FIELD

Embodiments of the present disclosure relate in general to pop up assembly of tent structures such as a fully-enclosed camping tent or a sunshade, and more particularly, to a pole assembly for such structures.

BACKGROUND

Structures configured for pop-up assembly of soft-sided tent structures, such as a fully-enclosed tent for camping or a partially-enclosed sunshade, are popular. Generally, such structures may be composed of a cloth (that is waterproof, water resistant and/or sun-filtering), and a plurality of poles. The poles pass through and support various portions of the cloth to define a desired structure when assembled. The assembled tent structure may be fully or partially enclosed.

Typically, such tents or other structures will be highly portable, such that their size when folded should be small relative to their size when assembled. As a result, pole assemblies are typically used which can be variably assembled for use, or broken down and/or folded for storage and transportation. In particular, multiple shorter pole sections may be connected to one another to create a longer, straight or curved pole assembly. The sections may be joined together by a cord, as a connection line, to keep the sections connected when in an unassembled, foldable configuration.

In many circumstances, such pop-up structures provide for light weight, mobility, resistance to sun and rain, and in some cases low cost. However, for some users, assembly may be difficult or slow—especially for users who do not frequently assemble their tents or structures, or when trying to insert poles into the material sleeves in low light or adverse weather conditions.

Some efforts have been made at improving assembly of such structures. For example, Korean patent publication KR20150007112A discloses a pole assembly in which poles include multiple sections joined together by a connection line. The pole sections require two different coupling elements (i.e. male and female) inserted into each pole segment end that couples to another pole segment. The coupling elements serve to keep the connection line centered and facilitate engagement of the pole segments with one another. By maintaining the connection line in a centered position within each pole sections, the pole assembly may theoretically be rapidly assembled by pulling on the connection line, with the connection line serving to line up the pole sections ends and then pull the pole sections together. Such an assembly technique may save time and effort as compared to manually inserting each pole section into another, end to end.

While assemblies such as those disclosed in KR20150007112A may provide some improvements, the insertion of two different types of coupling elements into the pole section ends may increase the cost and/or complexity of manufacture. Also, in some circumstances, pole sections may stick or fail to align perfectly, requiring time-consuming and frustrating manual manipulation of the pole sections during assembly. The gap between pole sections may also allow tent fabric or other objects to get caught between adjacent pole sections during assembly, which can cause jamming and possibly damage the fabric or objects. For these and other reasons, alternative pole assembly structures may be desirable.

SUMMARY

In accordance with one aspect, a tent pole assembly includes two or more hollow pole sections, including at least a first end pole section and a second end pole section. One or more middle pole sections may also be provided. The pole sections may be cylindrical in shape, and may be semi-rigid and/or elastic. A tension line passes through an interior cavity of each pole section, and is secured to the first end pole section. The tension line passes outside the second end pole section (e.g. through a hole or opening), and may be secured to the second end pole section via, e.g., securing a tension line loop end over a hook, or use of a cord lock, latch or pawl. The tension line may be attached at one end to a pole end tip inserted into a pole section.

One or more line centering components are provided threaded on the tension line, between adjacent pole sections. The line centering components facilitate engagement of adjacent pole sections (e.g. insertion of a pole section into an adjacent pole connector) when tension is applied to the tension line. The line centering components may be, for example, spherical in shape, having a diameter enabling insertion into a pole connector but precluding passage through an interior cavity of a pole section. In other embodiments, the line centering components may be elongated, with an internally-facing side staying within a pole connector and an externally-facing side either extending out from a pole connector when the tension line is not under tension, or pushed into the pole connector when the tension line is under tension. In some embodiments, the pole connectors may be wholly within the pole sections.

Applying tension on the tension line (e.g. via pulling) may act to draw together the pole sections, transitioning the pole assembly from an unassembled state to an assembled state, with line centering components facilitation smooth insertion of pole sections into adjacent pole connectors. Springs may be provided within the pole connectors, which act to eject pole sections from pole connectors upon release of tension in the tension line.

DETAILED DESCRIPTION OF THE DRAWINGS

Figure 1:
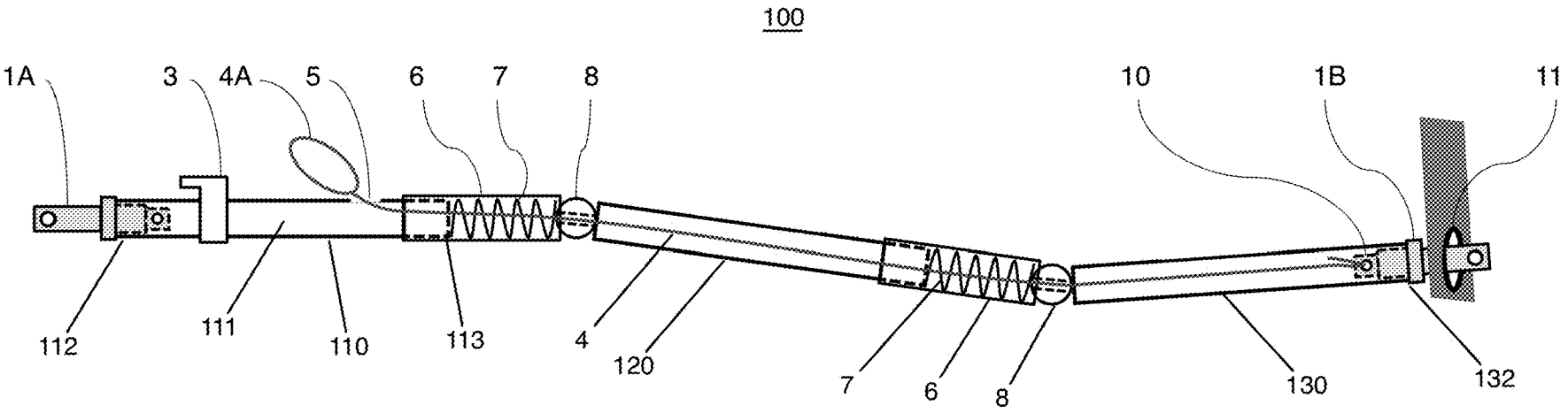
FIG. 1 is a longitudinal cross-sectional view of a pole assembly in an unassembled configuration.

While this invention is susceptible to embodiment in many different forms, there are shown in the drawings and will be described in detail herein several specific embodiments, with the understanding that the present disclosure is to be considered as an exemplification of the principles of the invention to enable any person skilled in the art to make and use the invention, and is not intended to limit the invention to the embodiments illustrated.

FIG. 1 is a longitudinal cross-sectional view of a pole assembly 100, comprised of multiple pole segments 110, 120 and 130. For clarity of illustration, the embodiment of FIG. 1 includes end pole segments 110 and 130 and a single middle pole segment 120. However, it is contemplated and understood that in many embodiments, the pole assembly will include multiple instances of middle segment 120, which may each have a structure identical or comparable to that of middle segment 120, thereby enabling longer pole assemblies relative to the length of each individual pole segment 110, 120 and 130.

Each pole segment (which may also be referred to as pole sections) may be cylindrical in shape, with a semi-rigid, elastic outer shell and a hollow center cavity. The pole segments may be formed from materials such as fiberglass, aluminum, carbon fiber or plastic. End segments 110 and 130 each have a pole end tip 1A and 1B, respectively, inserted into their outward-facing ends 112 and 132, respectively. End tips 1A, 1B provide, inter alia, an outward-facing structure that may be utilized for securing a pole to another portion of a popup structure (e.g. tent or sunshade fabric 11, or a ground stake).

End segment 110 includes an opening 5 enabling access through the end segment cylindrical wall to the center cavity 111 therein. Tension line 4 may pass between an outside portion of end segment 110 and the center cavity 111 thereof, through opening 5. Tension line 4 includes a loop 4A at a first end thereof, with the loop situated outside of end segment 110. End segment 110 also includes hook assembly 3 secured thereto, mounted to or exposed outside of end segment 110 at a position between that of outward facing end 112 and the location of opening 5. The tension line 4 may be removably attached to end segment 110 by, e.g., attaching the tension line loop 4A to hook assembly 3 (thereby maintaining tension line 4 under tension), and removing it therefrom (thereby releasing tension from tension line 4).

Pole connectors 6 may each be formed from a relatively short, cylindrical section, preferably having a diameter greater than that of end segment 110. In some embodiments, the inner diameter of pole connector 6 will be slightly greater than the outer diameter of a pole segment to which it is fixedly attached. For example, with reference to end segment 110, the pole connector 6 provides a secure fit when pole connector 6 is positioned over middle-facing end 113 of segment 110. Pole connector 6 may be fixedly attached to end segment 110 via, e.g., friction fit, adhesive, threaded engagement, or the like. In yet other embodiments, pole connection 6 may be formed (e.g. molded) integrally with a pole section or segment such as end segment 110, such that they are two elements of a single structure. In either case, each pole connector 6 is attached to one pole segment and configured for removable engagement with an adjacent pole segment (such as via a sliding insertion of an adjacent pole segment into a pole connector, or sliding insertion of the pole connector into an adjacent pole segment).

A spiral compression spring 7 is positioned within pole connector 6. Compression spring 7 is not under tension when pole assembly 100 is in the unassembled state as illustrated in FIG. 1.

Pole assembly 100 further includes line centering components 8. Line centering components 8 are mounted to tension line 4 and positioned between each adjacent pole section 110, 120, 130. Preferably, line centering components 8 are not fixedly attached to any of the pole sections, but are rather movable along tension line 4. In some embodiments, line centering components 8 may each be formed having a circular cross-section, such as a solid spherical structure with a hole or channel in the middle thereof through which tension line 4 passes. In some embodiments, line centering components 8 may have an outer diameter that is greater than that of pole sections 110, 120, 130 but which is less than the inner diameter of a pole connector 6. When in an unassembled state, and particularly when transitioning between an unassembled state and an assembled state, line centering components 8 may fill gaps between adjacent pole sections, thereby inhibiting structure components such as tent or sunshade fabric from getting introduced and caught between pole sections during assembly—thereby potentially avoiding jamming and/or damage to the fabric.

Thus, tension line 4 passes from outside of pole segment 110, through a portion of the interior cavity of pole segment 110 towards end 113, through the center of pole connector 6 and compression spring 7, through line centering component 8, through a central cavity in pole segment 120, through another pole connector 6 and spiral compression spring 7, through another line centering component 8, and through end pole segment 130. An end of tension line 4 can then be secured within end pole segment 130, such as via tying to an eyelet 10 in pole end tip 1B.

Figure 2:
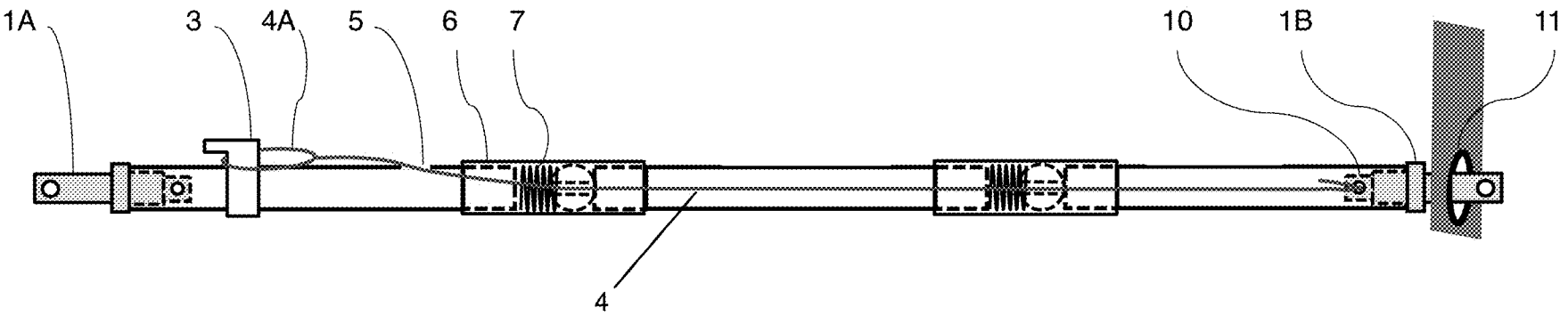
FIG. 2 is a longitudinal cross-sectional view of the pole assembly of FIG. 1, in an assembled configuration.

In order to assemble pole assembly 100, a user may simply pull the loop end 4A of tension line 4 passing outside of end pole segment 110, thereby applying tension to tension line 4, and secure the loop end over hook 3. FIG. 2 illustrates such a configuration. In so doing, the rounded shape of line centering components 8 promote smooth engagement of an adjacent pole section within an adjacent pole connector 6 as the pole sections are pulled together. Spherical line centering components 8 are reliably engaged on one side by an open end of a pole section, and pushed thereby into a pole connector 6 on the other side. The movement of line centering components 8 into pole connectors 6 serves to compress compression springs 7, by pressing against a first end of compression spring 7 while the spring's opposite end abuts an adjacent pole segment (with compression spring 7 being sized with a diameter sufficient to avoid compression spring 7 being pushed into a pole segment). The expansive force from compression springs 7 may help maintain tension on tension line 4 when tension line 4 is looped over hook 3, thereby providing a more secure engagement.

Compression springs 7 also facilitate rapid and reliable disassembly of pole assembly 100, whereby the assembly returns to the configuration illustrated in FIG. 1. A user removes the loop end 4A of tension line 4 from hook 3, and releases it. Compression springs 7, no longer under tension, decompress and expand towards their resting state, pushing or ejecting line centering components 8 (and therefore each adjacent pole section) out from pole connectors 6. The pole sections may then be folded for compact storage or transport, with the tension line maintaining the relative ordering of components relative to one another and maintaining a single assembly.

Use of a single line centering component, positioned between adjacent pole sections, may provide a number of advantages in some embodiments. For example, the single line centering component threaded on tension line 4 may reduce component count, cost, weight and/or manufacturing or assembly complexity, as compared to alternative designs requiring end caps within each pole section. Additionally, the line centering components described herein may serve to fill (wholly or partially) gaps between adjacent pole sections, thereby reducing risk of tent/sunshade fabric or other objects from becoming introduced therebetween as the pole sections are pulled together, possibly jamming pole sections, preventing pole sections from properly engaging with one another, and/or damaging the fabric or other objects.

Figure 3:
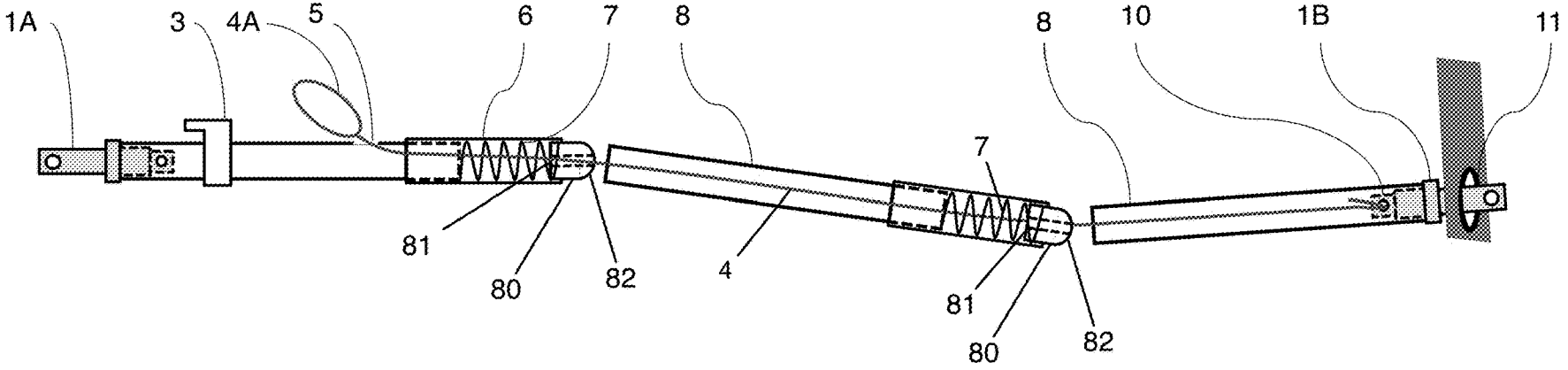
FIG. 3 is a longitudinal cross-sectional view of a further embodiment, in which each line centering element is secured to a compression spring.

In the embodiment of FIGS. 1 and 2, line centering component 8 comprises a spherical structure freely floating over tension cord 4, which passes therethrough. However, other configurations may be utilized within the scope contemplated hereby. FIG. 3 illustrates one such alternative embodiment, in an unassembled state. In FIG. 3, an internally-facing side 81 of each line centering component 80 is secured to an outward-facing end of a compression spring 7, thereby maintaining the internally-facing side 81 within the pole connector. Meanwhile, an externally-facing side 82 of line centering component 80 extends out from pole connector 6 when the tension line is not under tension and the pole segments are separated, but may be retractable into the pole connector when the tension line is under tension and the pole segments are joined together. Thus, line centering component 80 is maintained at least partially within pole connector 6, with tension line 4 passing through a central channel or hole therein. In the embodiment of FIG. 3, line centering components 80 are illustrated having an elongated bullet-shape, with relatively flat end 81 configured for attachment to compression spring 7 (e.g. via physical engagement, adhesive or both), and rounded or semi-spherical end 82 facilitates smooth engagement with an end of an adjacent pole section throughout a range of angles of engagement.

Figure 4:
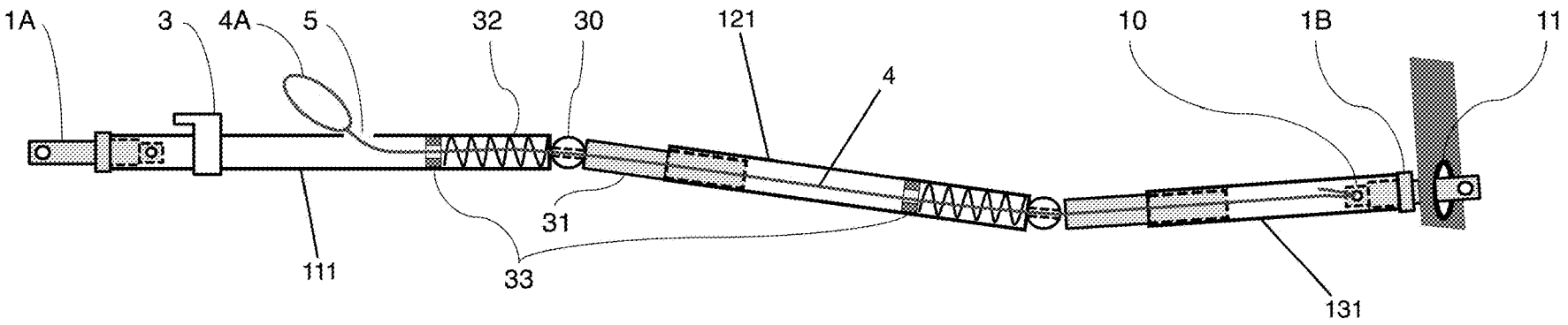
FIG. 4 is a longitudinal cross-sectional view of a pole assembly in an unassembled configuration, in accordance with another embodiment.

The embodiments of FIGS. 1-3 illustrate pole connectors having a diameter greater than the pole sections that they join, such that facing ends of adjacent pole sections are both inserted within the pole connector in an assembled configuration. In such embodiments, the resulting assembled pole may not have a uniform diameter across its length, with the pole connectors forming slight bulges along the length of the pole. However, in other embodiments, a pole connector structure can be formed such that it exists entirely within the pole section circumference in an assembled configuration. FIG. 4 illustrates such an embodiment.

In FIG. 4, tension line 4 runs through hollow pole sections 111, 121 and 131, and the pole connectors i.e. pole connector 31. Pole connector 31 is a cylindrical section extending from the end of pole section 121 towards pole section 111. Pole connector 31 has an outer diameter less than that of the inner diameter of pole section 111. Pole connector 31 is preferably fixedly mounted to pole section 121 (e.g. via a portion of pole connector 31 being inserted into pole section 121 and attached via adhesive or welding, or by pole connector 121 and pole section 121 being integrally molded or cast as a single physical component).

Line centering component 30 is positioned between pole section 111 and pole connector 31, movably attached to tension line 4 e.g. via tension line 4 running through a central channel or passage as shown. Line centering component 30 is generally spherical in shape, with a diameter less than the inner diameter of pole section 111 and greater than the inner diameter of pole connector 31. A spring 32 is mounted within pole section 111, with one end of the spring facing pole connector 31 and the other end of spring 32 fixedly mounted within pole section 111 (e.g. by being adhered to an internal stopper 33).

In operation, the application of tension to tension line 4 (e.g. via pulling loop 4A towards pole tip 1A) draws pole sections 111, 121 and 131 together. Pole connector 31 contacts line centering component 30 and pushes line centering component 30 into the open end of pole section 111, thereby compressing spring 32 while simultaneously guiding pole connector 31 into the open end of pole section 111. When fully assembled, line centering component 30 and pole connector 31 are fully encompassed within pole sections 111 and 121, with spring 32 in a compressed state. Pole sections 111 and 121 butt up against one another, and pole connector 31 acts to maintain pole sections 111 and 121 in an aligned state, such that they act as a continuous structural member for assembly of, e.g., a tent. When tension is released from tension line 4, spring 32 helps eject line centering component 30 pole connector 31 out of pole section 111, returning the pole to an unassembled state. Comparable mechanisms may be used to join other pole sections within a longer pole assembly (such as joining sections 121 and 131 in the three-section embodiment illustrated in FIG. 4).

In some embodiments, pole assemblies as described herein may be permanently inserted into sleeves formed within tent fabric, eliminating any need to insert and remove the pole assemblies from tent sleeves each time a tent or structure is pitched or taken down. In other embodiments, the pole assemblies described herein may be beneficially utilized for rapid and reliable assembly, separately from any tent or other structure in which the pole assemblies may be utilized.

While certain embodiments may be utilized in the context of a pole structure in which a pole connector is placed on the outside of each pole section (i.e. the pole connector diameter is greater than the pole section diameter), the same concept may be applied to embodiments in which pole connectors are placed inside each pole section (i.e. the pole connector diameter is less than the pole section diameter).

Furthermore, while the tension line may, in some embodiments, include a loop end for securing over a hook or other retention structure, in other embodiments, alternative mechanisms for securing the tension line under tension may be utilized. For example, a cord locking mechanism, latch or pawl may be used to maintain the tension line under tension when in an assembled state.

While certain embodiments of the invention have been described herein in detail for purposes of clarity and understanding, the foregoing description and Figures merely explain and illustrate the present invention and the present invention is not limited thereto. It will be appreciated that those skilled in the art, having the present disclosure before them, will be able to make modifications and variations to that disclosed herein without departing from the scope of the invention or appended claims.

The invention claimed is:

1. A tent pole assembly comprising:

two or more hollow pole sections comprising at least a first end pole section and a second end pole section, and optionally including one or more middle pole sections;

a tension line passing through an interior cavity of each pole section, the tension line secured to said first end pole section and passing outside of said second end pole section; and one or more line centering components through which the tension line passes, each line centering component positioned between adjacent pole sections and not fixedly attached to any of said pole sections and fully recessed within the tent pole assembly when the tent pole assembly is in an assembled state; and one or more compression springs, each of said springs positioned along the tension line between a pole section and line centering component, and acting to separate at least one of said pole sections from another pole section upon release of tension on the tension line.

2. The tent pole assembly of claim 1, in which the tent pole assembly is movable between a disassembled state and an assembled state by applying and relieving tension on the tension line; wherein during transition from a disassembled state to an assembled state, the line centering components occupy space between adjacent pole sections to inhibit the introduction of tent fabric between pole sections.

3. The tent pole assembly of claim 2, in which the hollow pole sections are semi-rigid and elastic.

4. The tent pole assembly of claim 1, in which the first end pole section comprises a first pole end tip inserted into an outward-facing end thereof, wherein the tension line is secured to an inward-facing portion of the first pole end tip.

5. The tent pole assembly of claim 1, in which the second end pole section comprises an opening between the second end pole section interior cavity and an area outside of the second end pole section.

6. The tent pole assembly of claim 5, in which the tension line is configured for removable attachment to the second end pole assembly.

7. The tent pole assembly of claim 6, wherein the tension line comprises a loop at an end situated outside the second end pole section; and wherein the second end pole section further comprises a hook over which the loop may be removably attached.

8. The tent pole assembly of claim 7, further comprising a plurality of pole connectors, each pole connector fixedly attached to one pole segment and configured for removable engagement with an adjacent pole segment;

wherein pulling the tension line loop over the hook causes insertion of one of said pole segments and one of said line centering components into each pole connector.

9. The tent pole assembly of claim 8, further comprising a spring assembly within each pole connector; wherein releasing the tension line loop from the hook enables decompression of the spring assemblies to eject a pole segment from each pole connector.

10. The tent pole assembly of claim 6, further comprising a cord locking mechanism for removable attachment of the tension line to the second end pole assembly.

11. The tent pole assembly of claim 1, further comprising one or more pole connectors, each pole connector fixedly attached to one pole segment and configured for removable engagement with an adjacent pole segment.

12. The tent pole assembly of claim 1, wherein each of the one or more line centering components is integrated into an adjacent one of said compression springs.

13. The tent pole assembly of claim 1, further comprising a plurality of pole connectors, each pole connector fixedly attached to one pole segment and configured for removable engagement with an adjacent pole segment; and in which the line centering components each comprise an internally-facing side directed towards and maintained within a pole connector, and an externally-facing side that extends out from within a pole connector when the tension line is not under tension, and retractable within the pole connector when the tension line is under tension.

14. The tent pole assembly of claim 13, in which the line centering components each comprise an elongated shape with a semi-spherical externally-facing side.

15. The tent pole assembly of claim 14, further comprising springs within each pole connector, attached to the line centering component internally-facing side.

16. The tent pole assembly of claim 1, further comprising:

one or more pole connectors, wherein each pole connector is fixedly attached to a first of said pole segments, extends toward an adjacent second of said pole segments, and is configured for removable insertion into an internal cavity of said second pole segment.

17. The tent pole assembly of claim 16, in which the pole connector and pole segments are cylindrical, with the pole connector having an outside diameter less than an inside diameter of an open end of said second pole segment that is facing towards the first pole segment.

18. A tent pole assembly comprising:

two or more hollow pole sections comprising at least a first end pole section and a second end pole section, and optionally including one or more middle pole sections;

a tension line passing through an interior cavity of each pole section, the tension line secured to said first end pole section and passing outside of said second end pole section; and one or more line centering components which the tension line passes, each line centering component positioned between adjacent pole sections and not fixedly attached to any of said pole sections; and one or more pole connectors, each pole connector fixedly attached to one pole segment and configured for removable engagement with an adjacent pole segment;

in which the pole segments are cylindrical, and the pole connectors comprise cylindrical sections each having a diameter greater than a diameter of a pole segment to which the pole connector attaches and to which the pole connector removably engages.

19. The tent pole assembly of claim 18, wherein the line centering components have a circular cross-section and are sized for insertion within the pole connector.

20. The tent pole assembly of claim 19, in which the line centering components comprise spherical structures having a diameter less than an inner diameter of the pole connectors and greater than an outer diameter of the pole segments, the spherical structures further comprises channels through their middles through which the tension line passes.

21. The tent pole assembly of claim 19, further comprising a spring assembly within each pole connector.

22. A tent pole assembly comprising:

two or more hollow pole sections comprising at least a first end pole section and a second end pole section, and optionally including one or more middle pole sections;

a tension line passing through an interior cavity of each pole section, the tension line secured to said first end pole section and passing outside of said second end pole section; and one or more line centering components which the tension line passes, each line centering component positioned between adjacent pole sections and not fixedly attached to any of said pole sections; and one or more pole connectors, wherein each pole connector is fixedly attached to a first of said pole segments, extends toward an adjacent second of said pole segments, and is configured for removable insertion into an internal cavity of said second pole segment;

in which the pole connector and pole segments are cylindrical, with the pole connector having an outside diameter less than an inside diameter of an open end of said second pole segment that is facing towards the first pole segment; and in which said line centering components are spherical in shape, the tent pole assembly further comprising a spring inside the internal cavity of the second pole segment, wherein a first end of said spring facing away from the open end of the second pole segment is fixedly mounted within the second pole segment, and a second end of the spring facing the open end of the second pole segment is movable within the second pole segment.

* * * * *